US009829864B2

(12) United States Patent
Fleury et al.

(10) Patent No.: US 9,829,864 B2
(45) Date of Patent: Nov. 28, 2017

(54) ELECTROMECHANICAL OR DIGITAL WATCH INCLUDING A DIAL AND METHOD OF MANUFACTURING SUCH A DIAL

(71) Applicant: ETA SA MANUFACTURE HORLOGERE SUISSE, Grenchen (CH)

(72) Inventors: Emmanuel Fleury, Moutier (CH); Jean Laconte, Colombier (CH); Pascal Lagorgette, Bienne (CH)

(73) Assignee: ETA SA MANUFACTURE HORLOGERE SUISSE, Grenchen (CH)

( * ) Notice: Subject to any disclaimer, the term of this patent is extended or adjusted under 35 U.S.C. 154(b) by 0 days.

(21) Appl. No.: 15/102,458

(22) PCT Filed: Aug. 18, 2014

(86) PCT No.: PCT/EP2014/067555
§ 371 (c)(1),
(2) Date: Jun. 7, 2016

(87) PCT Pub. No.: WO2015/090638
PCT Pub. Date: Jun. 25, 2015

(65) Prior Publication Data

US 2016/0313705 A1 Oct. 27, 2016

(30) Foreign Application Priority Data

Dec. 16, 2013 (EP) ..... 13197462

(51) Int. Cl.
*G04G 17/06* (2006.01)
*G04G 21/00* (2010.01)
(Continued)

(52) U.S. Cl.
CPC ..... *G04G 17/06* (2013.01); *G04G 17/045* (2013.01); *G04G 21/08* (2013.01)

(58) Field of Classification Search
CPC ..... G04G 17/06; G04G 17/045; G04G 21/08; G04G 17/00; G04G 17/04; G04G 21/00
See application file for complete search history.

(56) References Cited

U.S. PATENT DOCUMENTS 5,453,960 A * 9/1995 Teres ..... G04G 21/08 368/224
5,742,564 A * 4/1998 Kuschel ..... G04G 21/08 368/224
(Continued)

FOREIGN PATENT DOCUMENTS

DE 297 22 548 U1 3/1998
DE 197 58 924 B3 7/2012
(Continued)

OTHER PUBLICATIONS

International Search Report dated Jun. 1, 2015 for PCT/EP2014/067555 filed on Aug. 18, 2014.

*Primary Examiner* — Sean Kayes
(74) *Attorney, Agent, or Firm* — Oblon, McClelland, Maier & Neustadt, L.L.P.

(57) ABSTRACT

An electromechanical or digital watch includes a middle part that delimits with a glass a watch case. The glass includes an upper surface oriented upwardly, and a lower surface oriented towards the watch case. The watch also includes a dial made of an electrically non-conductive material. The dial includes a lower surface and an upper surface located opposite the watch case. Electrically conductive paths for the connection of one or more electronic components are structured on at least one of the lower or upper surfaces of the dial. The watch includes a flange that ensures, via the electrically conductive paths, the electrical connection
(Continued)

Figure 1:
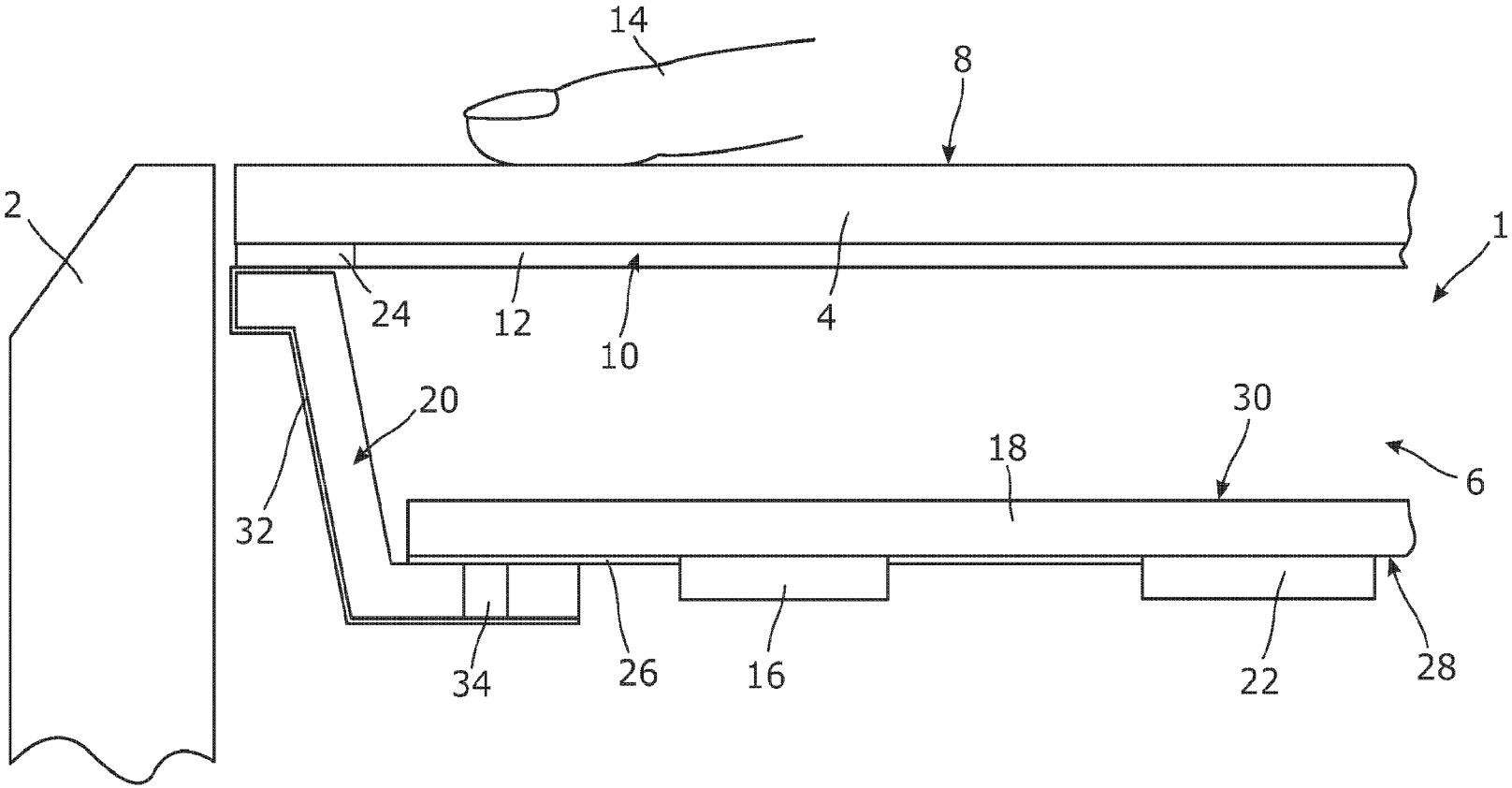

between an electronic device arranged on the lower surface of the glass and the electronic components. The flange supports the dial or is made in one-piece with the dial.

8 Claims, 2 Drawing Sheets

(51) Int. Cl.
*G04G 17/04* (2006.01)
*G04G 21/08* (2010.01)

(56) References Cited

U.S. PATENT DOCUMENTS

| | | | | |
|---|---|---|---|---|
| 6,067,277 | A | 5/2000 | Dinger et al. | |
| 6,868,046 | B2 * | 3/2005 | Farine | G04G 21/08 368/187 |
| 9,516,767 | B2 * | 12/2016 | Jufer | G04G 17/06 |
| 2002/0060953 | A1 * | 5/2002 | Farine | G04C 3/14 368/69 |
| 2006/0013074 | A1 * | 1/2006 | Ueno | G04C 17/00 368/226 |

FOREIGN PATENT DOCUMENTS

| | | | |
|---|---|---|---|
| EP | 1 207 439 | A1 | 5/2002 |
| EP | 1 734 422 | A1 | 12/2006 |

* cited by examiner

ELECTROMECHANICAL OR DIGITAL WATCH INCLUDING A DIAL AND METHOD OF MANUFACTURING SUCH A DIAL

This is a National phase application in the United States of International patent application PCT/EP2014/067555 filed Aug. 18, 2014 which claims priority on European patent application 13197462.8 filed Dec. 16, 2013. The entire disclosures of the above patent applications are hereby incorporated herein by reference.

The present invention concerns a watch including a dial. More specifically, the present invention concerns an electromechanical or digital watch including at least one electronic device arranged inside the watch case.

Within the meaning of the present invention, an electromechanical watch is a watch including at least one indicator of a time-related quantity or a non-time related quantity driven by an electrical motor. Further, a digital watch means a watch including at least one digital device for the display of a time-related quantity or a non time-related quantity.

Likewise, within the meaning of the invention, a dial is an indicator member which carries various time-related or non time-related indications.

Electromechanical watches, like digital watches, include a plurality of discrete or integrated electronic components necessary for the operation thereof. These electronic components are typically mounted on printed circuit boards housed inside the watch cases, underneath the dial surface and remote from the dial.

It is understood that these printed circuit boards constitute additional components which lead to extra production costs and which occupy space within the volume of the watch case, such that it is sometimes difficult to house them in the case.

It is an object of the present invention to overcome these drawbacks in addition to others by providing a dial for an electromechanical or digital watch which advantageously makes it possible, at least partially, to omit printed circuit boards.

To this end, the present invention concerns an electromechanical or digital watch, the watch including a middle part which, with a glass, delimits a watch case, the glass including an upper surface oriented towards a user, and a lower surface oriented towards the watch case, the watch also including a dial made of an electrically non-conductive material, the dial including a lower surface and an upper surface located on the side of the user, the watch being characterized in that electrically conductive paths for the connection of one or more electronic components are structured on at least one of the lower or upper surfaces of the dial.

According to a complementary feature of the invention, the dial is made of glass, of a plastic material or of a ceramic material.

As a result of these characteristics, the present invention provides a watch whose dial is made of an electrically non-conductive material, so that at least one of the upper and lower surfaces of the dial can be utilised for structuring electrically conductive paths allowing for the electrical connection of at least one discrete or integrated electronic component. It is therefore possible to omit, or at the very least, to limit the surface of the printed circuit boards necessary for mounting electronic watch components, which makes it possible to limit costs in terms of the number of printed circuit boards used and production time, and to reduce the space required to house the timepiece movement inside the watch case.

Figure 2:
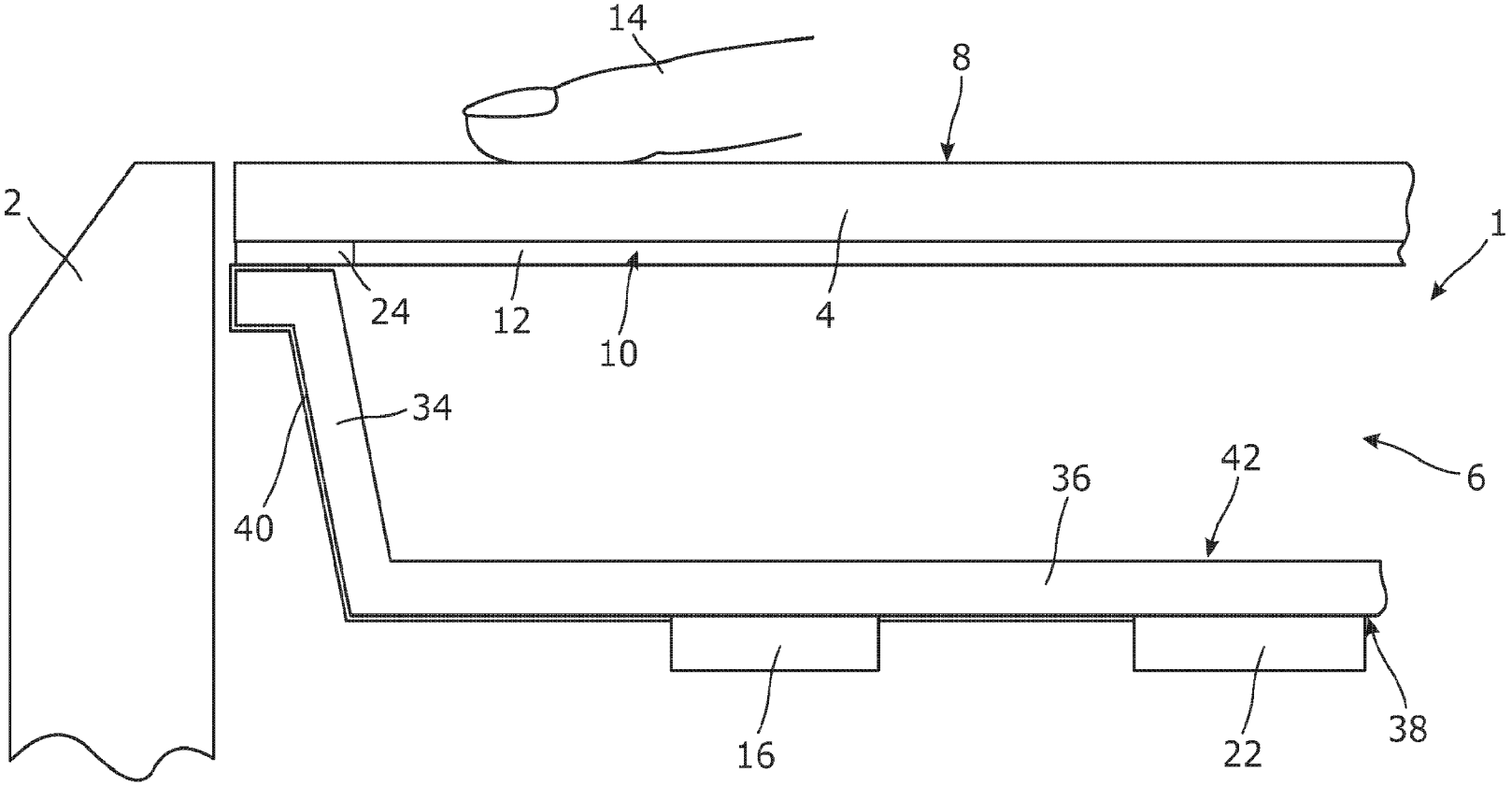

Other features and advantages of the present invention will appear more clearly from the following detailed description of one embodiment of a watch according to the invention, this example being given solely by way of non-limiting illustration with reference to the annexed drawing, in which:

FIG. 1 is a cross-section of a watch provided with a dial according to the invention; and FIG. 2 is a cross-section of a watch provided with a dial according to a variant embodiment of the invention.

The present invention proceeds from the general inventive idea which consists in using one and/or other of the upper and lower surfaces of a watch dial made of an electrically non-conductive material to structure conductive paths for connecting discrete or integrated electronic components required for the operation of the watch. Consequently, it is possible to omit, or at least to limit the surface of the printed circuit boards, which makes it possible to limit production time and costs, and to reduce the space required to house the timepiece movement inside the watch case.

The present invention will be described with reference to a timepiece including a glass on whose lower surface tactile keys are structured. It goes without saying that this example is given purely by way of non-limiting illustration, and that a watch dial according to the invention can be used with any type of electronic device integrated in a watch case.

FIG. 1 annexed to this patent application is a cross-section of a watch case provided with a dial according to the invention. Designated as a whole by the general reference numeral 1, this watch includes a middle part 2 which, with a watch glass 4, delimits a watch case 6.

Watch glass 4 has an upper surface 8 facing the user of watch 1 and a lower surface 10 facing the watch case 6. An electronic device is arranged on the lower surface 10 of glass 4. The electronic device may be any type of device. It may be a digital display device, for example a liquid crystal display, or (see FIG. 1) first conductive paths 12 made of a transparent, electrically conductive material such as indium tin oxide, known as ITO. The function of these first conductive paths 12 is to form, on the surface of glass 4, tactile keys which are sensitive to variations in capacitance and enable the user, by applying a finger 14, to enter instructions into an electronic tactile key management circuit 16. This electronic management circuit 16 is mounted on a lower surface of a dial 18 of the invention housed inside watch case 6, underneath and remote from first conductive paths 12 and supported by a flange 20. The assembly is supplemented by an electronic circuit 22 which controls the execution of a horological or other function in accordance with instructions provided by electronic management circuit 16.

The first conductive paths 12 define first electrical contact pads 24 which must be transferred from the lower face 10 of glass 4 to dial 18. According to the present invention, dial 18 includes for this purpose second conductive paths 26 which correspond to electrical contact pads 24 and which are connected to electronic management circuit 16 and to electronic control circuit 22. In the example shown in the drawing, the second conductive paths 26 are only structured on a lower surface 28 of dial 18. It goes without saying, however, that conductive paths can also be structured on the upper surface 30 of dial 18, in particular if the conductive paths are transparent.

As illustrated in the drawing, a generally circular flange 20 may be provided for this purpose, arranged underneath glass 4 of watch 1. This flange 20 is made of an electrically non-conductive material and includes means which must be able to ensure the electrical connection between electrical pads 24 and second electrical conductive paths 26. These electrical connection means are formed by third conductive paths 32 which come into contact with electrical contact pads 24 on the one hand, and with second electrical conductive paths 26 on the other hand. To ensure a good electrical contact between the third conductive paths 32 arranged on flange 20 and the second conductive paths 26 arranged underneath the surface of dial 18, through holes or vias 34 are arranged in flange 20 in the area where the latter supports dial 18. According to a variant, it is also possible to envisage structuring bumps on the third conductive paths 32 at the locations where these third conductive paths 32 face second conductive paths 26.

In the case where dial 18 is made of an electrically non-conductive material such as glass, a plastic material, or a ceramic material, the second conductive paths 26 may be made for example by photolithographic structuring of an ITO layer. Second conductive paths 26 may also be made, for example, of copper, silver or aluminium using a method such as a laser treatment method making it possible to obtain a moulded interconnect device or MID. Thereafter, the second conductive paths 26 are structured by an electroforming method. According to a variant, it is also possible to structure second conductive paths 26 on the surface of dial 18 by printing with electrically conductive ink. It is also possible to envisage making dial 18 by a method for the bi-injection of a plastic material and a conductive material followed by an electroforming step.

It goes without saying that this invention is not limited to the embodiment that has just been described and that various simple modifications and variants can be envisaged by those skilled in the art without departing from the scope of the invention as defined by the annexed claims. It will be understood, in particular, that in products such as the wristwatch marketed under the registered trademark T-Touch®, the electrical connection between the tactile keys structured on the lower surface of the glass and the electronic tactile key management circuit may also be accomplished by means of elastomer connectors, also known under the trade name of Zebra® connectors. These elastomer connectors are formed of a series of alternate conductive and insulating layers typically made of elastomer, which provide high density electrical path connections. It is also evident that the conductive paths structured on the dial according to the invention do not necessarily serve to connect tactile keys arranged on the lower surface of a watch glass to electronic management and control circuits fixed to the dial. It is therefore entirely possible to envisage structuring conductive paths on one and/or the other of the lower and upper dial surfaces to connect to each other, for example, the electronic management and control circuits of a component housed inside the volume of the watch case, such as an electrical stepping motor.

FIG. 2 is a cross section of a watch equipped with a dial according to a variant embodiment of the invention. In the following description, any elements identical to those described above with reference to FIG. 1 will be designated by the same reference numerals. As revealed by an examination of FIG. 2, a flange 34 is made in one-piece with a dial 36. This flange 34/dial 36 assembly is made of an electrically non-conductive material and includes means which must be able to ensure the electrical connection between the electrical contact pads 24 arranged on the lower face 10 of glass 4 and the electronic management 16 and control 22 circuits mounted on a lower surface 38 of the flange 34/dial 36 assembly. To this end, conductive paths 40 are arranged on at least one of the lower 38 or upper 42 faces of the flange 34/dial 36 assembly and make it possible to electrically connect electrical contact pads 24 to electronic management circuit 16 and to electronic control circuit 22. In the example shown in the drawing, conductive paths 40 are only structured on lower surface 38 of the flange 34/dial 36 assembly. It goes without saying, however, that conductive paths may also be structured on the upper surface 42 of the flange 34/dial 36 assembly, in particular, if these conductive paths are transparent. In the case where the flange 34/dial 36 assembly is made of an electrically non-conductive material such as glass, a plastic material or a ceramic material, the conductive paths 40 may be made for example by photolithographic structuring of an ITO layer. The conductive paths 40 may also be made for example of copper, silver or aluminium using a method such as a laser treatment method making it possible to obtain a moulded interconnect device or MID. Thereafter, conductive paths 40 are structured by an electroforming method. According to a variant, it is also possible to structure conductive paths 40 on the surface of the flange 34/dial 36 assembly by printing with an electrically conductive ink. It is also possible to envisage making the flange 34/dial 36 assembly by a method of bi-injection of a plastic material and a conductive material followed by an electroforming step. It will be understood that the embodiment that has just been described with reference to FIG. 2 has the particular advantage, in the case where it is required to connect an electronic component arranged on the lower surface of the glass to other electronic components fixed to the dial, of avoiding all of the bump or via type connecting elements normally used to ensure the connection between the flange and the dial.

The invention claimed is:

1. An electromechanical or digital watch, comprising:

a middle part that delimits with a glass a watch case, the glass including an upper surface oriented upwardly and a lower surface oriented towards the watch case;

a dial made of an electrically non-conductive material, the dial including a lower surface and an upper surface located opposite the watch case, wherein electrically conductive paths for the connection of one or more electronic components are structured on at least one of the lower surface and the upper surface of the dial; and a flange configured to ensure, via the electrically conductive paths, electrical connection between an electronic device arranged on the lower surface of the glass and the one or more electronic components, wherein the flange supports the lower surface of the dial.

2. The electromechanical or digital watch according to claim 1, wherein the dial is made of glass, a plastic material, or a ceramic material.

3. The electromechanical or digital watch according to claim 2, wherein the electrically conductive paths are made of indium-tin oxide, copper, silver, aluminium, or by a conductive ink.

4. The electromechanical or digital watch according to claim 1, wherein the electrically conductive paths are made of indium-tin oxide, copper, silver, aluminium, or by a conductive ink.

5. An electromechanical or digital watch, comprising:

a middle part that delimits with a glass a watch case, the glass including an upper surface oriented upwardly and a lower surface oriented towards the watch case;

a flange; and a dial made of an electrically non-conductive material, the dial including a lower surface and an upper surface located opposite the watch case, wherein electrically conductive paths for the connection of one or more electronic components are structured on the flange, wherein the one or more electronic components are structured on at least one of the lower surface and the upper surface of the dial, wherein the flange is configured to ensure, via the electrically conductive paths, electrical connection between an electronic device arranged on the lower surface of the glass and the one or more electronic components, wherein the flange is made in one-piece with the dial.

6. The electromechanical or digital watch according to claim 5, wherein the dial is made of glass, a ceramic material.

7. The electromechanical or digital watch according to claim 6, wherein the electrically conductive paths are made of indium-tin oxide, copper, silver, aluminium, or by a conductive ink.

8. The electromechanical or digital watch according to claim 5, wherein the electrically conductive paths are made of indium-tin oxide, copper, silver, aluminium, or by a conductive ink.

* * * * *